US007424949B2

(12) United States Patent
Kumar

(10) Patent No.: US 7,424,949 B2
(45) Date of Patent: Sep. 16, 2008

(54) SELF-DRAINING SOAP DISH UNIT WITH STRUCTURAL AND FUNCTIONAL ELEMENTS FOR ENHANCED DRYING AND ACCESSORY FEATURES

(76) Inventor: Sivathanu Bhagavath Kumar, 17402 Heather Oak Pl., Tampa, FL (US) 33647

( * ) Notice: Subject to any disclaimer, the term of this patent is extended or adjusted under 35 U.S.C. 154(b) by 62 days.

(21) Appl. No.: 10/947,193

(22) Filed: Sep. 22, 2004

(65) Prior Publication Data

US 2006/0060742 A1 Mar. 23, 2006

(51) Int. Cl.
*A47K 5/08* (2006.01)

(52) U.S. Cl. ..... 206/77.1; 220/572

(58) Field of Classification Search ..... 108/24; 206/77.1; 220/571, 572, 487
See application file for complete search history.

(56) References Cited

U.S. PATENT DOCUMENTS 4,133,443 A * 1/1979 Medina et al. ..... 220/476

6,152,294 A * 11/2000 Weinberg ..... 206/77.1

* cited by examiner

*Primary Examiner*—A. Joseph Wujciak, III

(57) ABSTRACT

The novel concept of a single embodiment, namely a self-draining soap dish unit fabricated with choice of materials, metals, sizes, shapes, styles, including the options for accessories, securable to fixed structure, in which the soap held in the container component of the unit is repositioned, by means of one or more integrated mechanisms, such as telescopic arm, pivoted leaver, hydraulic, hinge, pneumatic, motor, solenoids, springs and inclined plane, to a preferred location, such as sink, tub or shower floor, to enhance drying function of the soap, during use and thereafter, allowing water from the wet soap to drain into the preferred area and be eliminated, thus drying the soap effectively and efficiently, and is returned to its original position in the soap dish. The combined structural construction and functional elements of this single embodiment to enhance the drying feature of the soap makes this soap dish unit, unique and innovative.

6 Claims, 14 Drawing Sheets

Figure 1:
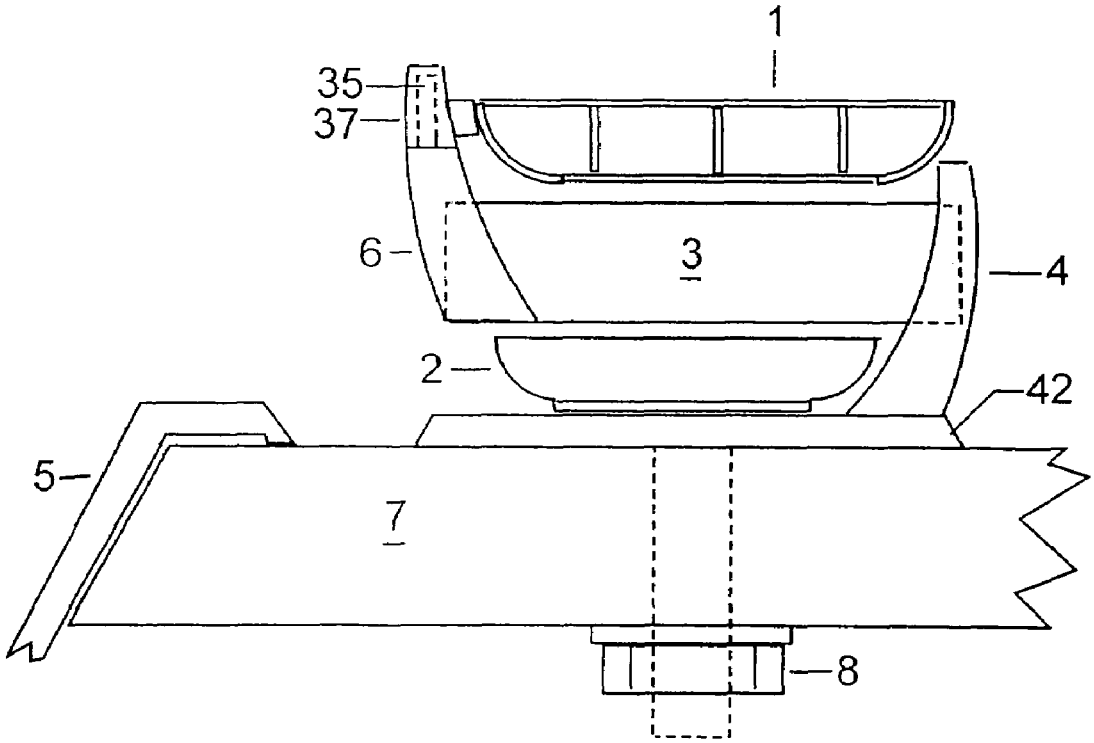

SELF-DRAINING SOAP DISH UNIT WITH STRUCTURAL AND FUNCTIONAL ELEMENTS FOR ENHANCED DRYING AND ACCESSORY FEATURES

CROSS REFERENCE TO RELATED APPLICATIONS

U.S. Patent Documents

| U.S. Pat. No. | Inventor | Title |
|---|---|---|
| 6,662,940 | Kowal | Draining soap dish for multiple bars of soap |
| 5,947,272 | Park | Soap case |
| 5,509,529 | Kelly | Soap Bar Holder |
| 6,691,337 | Banks | Cushioned Bath tub Support Apparatus |
| 5,680,929 | Von Seidel | Soap dish |
| 4,133,443 | Medina | Soap Dish |

STATEMENT REGARDING FEDERALLY SPONSORED RESEARCH OR DEVELOPMENT

Not Applicable

REFERENCE TO SEQUENCE LISTING

BACKGROUND OF THE INVENTION

The field of the invention relates to a novel concept of a single embodiment, namely a self-draining soapdish unit fabricated with choice of materials, metals, sizes, shapes, styles, including the options for accessories, securable to fixed structure or free standing, in which the soap held in the container component of the unit can be repositioned, by means of one or more integrated mechanisms, such as telescopic arm, pivoted leaver, hydraulic, hinge, pneumatic, motor, solenoids, springs and inclined plane, to a preferred location, such as sink, tub or shower floor, to enhance drying function of the soap, during use and thereafter, allowing water from the wet soap to drain into the preferred area and be eliminated, thus drying the soap effectively and efficiently, and is then returned to its original position in the soapdish, when desired. The combined structural construction and functional elements of this single embodiment to enhance and maximize the drying feature of the soap makes this soapdish unit, unique and innovative. The basic elements of this concept are amenable to variability of (a) various soap container shapes, sizes, materials, and metals (b) securing mechanisms and devices, movable or free standing (c) mechanism for repositioning the soap container component of the unit, by means of one or more integrated mechanisms, such as telescopic arm, pivoted leaver, hydraulic, hinge, pneumatic, motor, solenoids, springs and inclined plane; (d) application in location of use such as in showers, other sinks or tubs; in addition to (e) incorporating provisions to dry and/or store accessories such as shampoo, toothbrush and an additional soap for future use. Thus, in addition to enhancing and maximizing the drying features, these additional elements that the embodiment is amenable to, enhance the utility, appeal, and it's suitability for diverse needs and decors.

Soaps in general are hydrophilic and by virtue of their constituents, the location and purpose of use, tend to retain water in the container such as in conventional soap dish, where they may be stored. It is thus inherent for conventional soap dishes to contain a half-dissolved, soggy soap in addition to water in the lower level of the soap dish units. In addition to wastage of soap, the soap dish requires more frequent cleaning of the soap build up and draining of the water within the floor or drain tray of the soap dish, with the use of scrub or brush. Soggy soap also hinders the proper lathering of soap, comfortable use and hence proper utility of the soap.

Previous soap dish designs have attempted to incorporate design elements in soap dishes to improve effective water drainage from the soap dish. Examples of the prior art include U.S. Pat. No. 4,993,546, wherein a self draining soap dish construction provides a new and improved self draining soap dish wherein the same provides a forward trough within the soap dish in communication with a sink basin of an associated sink to permit continuous and automatic drainage of the soap dish in use.

U.S. Pat. No. 6,662,940 to Kowal, where the patent sets forth a draining soap dish for multiple bars of soap and more specifically pertains to holding a plurality of bars of soap, while preventing their softening by having a top plate with rectangular openings to hold soap with a U-shaped drainage slots and a bottom plate to receive the drainage.

U.S. Pat. No. 5,947,272 to Park, where the patent sets forth a soap case characterized to have a receiving portion that is designed to receive the bar of soap to be upright, in an angle and comprising a movement mechanism integrated within the soap dish design, thus enabling the water to leave the surface of the bar quickly, so that the soap dries quickly.

U.S. Pat. No. 5,509,529 to Kelley, where the patent sets forth a soap bar holder with a lid on a pivot, which is made to pivot by means of a pin that seals the soap dish when not in use and is spring loaded for easy access to soap by pressing the release button. The enclosure is slidable and removable with a mounting plate that makes this easy to access this enclosure for cleaning.

Other soap dish patents contain design elements that include a slope, an angle or a slope and a drain tray in the soap dish or the tray below the soap holder, thus enabling the water to leave the surface of the bar, in an attempt to permit the soap to drain water quickly.

The above referenced patents, in summary, are designs that have modifications in soap dish container designs with slopes, angles and troughs or those that have a receiving tray at the base of the soap dish that allows for draining of water from the soap dish relatively better than conventional soap dishes, but not instantly nor completely. However, these soap dish designs in all probability may continue to have moisture or soap buildup within a soap dish floor, require frequent soap dish clean up, and in addition, do not reduce the wastage of soap in the soap dish, which may not be completely dry. In addition, the water with the soap may remain in the soap dish itself or the base receiving unit of the soap dish, thus not ensuring a mechanism by which the soap can drain completely nor instantly, directly into the drain of the sink, shower or other drainage systems.

Thus, currently, there are no soapdish designs that incorporate a concept of a single embodiment, such as a self-draining soapdish unit, which includes the options of including accessories, securable to fixed structures or free standing, whereby the soap held in the container component of the unit can be repositioned, by means of one or more integrated mechanisms, such as telescopic arm, pivoted leaver, hydraulic, hinge, pneumatic, motor, solenoids, springs and inclined plane, to a preferred location, such as sink or shower, to enhance drying function of the soap, during use and thereafter, allowing water from the wet soap to drain directly into the preferred area and be eliminated, thus drying the soap effectively and efficiently, and which is then returned to its original position in the soapdish unit.

BRIEF SUMMARY OF THE INVENTION

The invention pertains to novel concept of a single embodiment, namely a self-draining soapdish unit fabricated with choice of materials, metals, sizes, shapes, styles, including the options for accessories, securable to fixed structure or free standing, in which the soap held in the container component of the unit can be repositioned, by means of one or more integrated mechanisms, such as, but not limited to, telescopic arm, pivoted leaver, hydraulic, hinge, pneumatic, motor, solenoids, springs and inclined plane, to a preferred location, such as sink, tub or shower floor, to enhance drying function of the soap, during use and thereafter, allowing water from the wet soap to drain into the preferred area and be eliminated, thus drying the soap effectively and efficiently, and is then returned to its original position in the soapdish, without compromising appearance, as it assumes a compact design as in a sink application or neatly tucked in a recess in other applications such as in a shower, once the soap is dry. The combined structural construction and functional elements of this single embodiment to enhance and maximize the drying feature of the soap makes this soapdish unit, unique and innovative.

The basic elements of this concept are amenable to variability of (a) various soap container shapes, sizes, materials, and metals (b) securing mechanisms and devices, movable or free standing (c) mechanism for repositioning the soap container component of the unit, by means of one or more integrated mechanisms, such as, but not limited to, telescopic arm, pivoted leaver, hydraulic, hinge, pneumatic, motor, solenoids, springs and inclined plane; (d) application in location of use such as, but not limited to, in showers, other sinks or tubs; in addition to (e) incorporating provisions to dry and/or store accessories such as shampoo, toothbrush and an additional soap for future use. Thus, in addition to enhancing and maximizing the drying features, these additional elements that the embodiment is amenable to, enhance the utility, appeal, and it's suitability for diverse needs and decors.

The single embodiment, namely, the self-draining soap dish unit, described herein attempts to overcome deficiencies of prior soap dish constructions and improves on previous designs by combining structural construction and functional elements, enabling the soap container to be drawn out of the original position from the soap dish unit to the desired area, such as hand sink, tub or floor of the shower, to drain water instantly during use and dry quickly and efficiently. In addition, it facilitates returning the soap to its original position after use and after the soap is dry with no potential for moisture or soap buildup within a soap container floor, as it drains into the sink, without requiring frequent soap dish clean up, but in addition, reducing the wastage of soap in the embodiment which can remain dry. Moving from functional position to original position also improves appearance and ensures safety and in appearance it resembles a conventional soap dish which people are accustomed to. The current invention thus fulfills a void in soap dish design.

The application of this embodiment is not limited to utilities such as sink, shower, tub or kitchen, but can be used in various other applications such as, but not limited to hospitals, restaurants and hotels and other applications as deemed necessary. All the above said elements described make this invention novel and versatile, with significant utility value to the consumer.

The purpose of the current soap dish design is to provide a new, improved, effective and efficient single embodiment of a self draining soap dish unit, which has all the advantages of the prior art soap dish designs and yet combined structural construction and functional elements to enhance and maximize the drying feature of the soap, thus overcoming the deficits of previous designs.

BRIEF DESCRIPTIONS OF THE SEVERAL VIEWS OF THE DRAWINGS

FIG. 1. is the side elevation of the embodiment. This illustrates the self draining soap dish unit insalled in suitable location in close proximity to sink 5, a section of the sink shown in the drawing. This unit is fitted with a telescopic arm 3 for movement. The soap container 1 is mounted at the outer end of the said telescopic arm using a pivot 35, the other end is attached to the attachment component 4 which holds the telescoping arm in the proper functional position and facilitates the soap container and the telescoping arm to be secured to other fixed structures 7 by suitable means 8. In this original position, a removable drain tray 2 is placed under the soap container 1.

Figure 2:
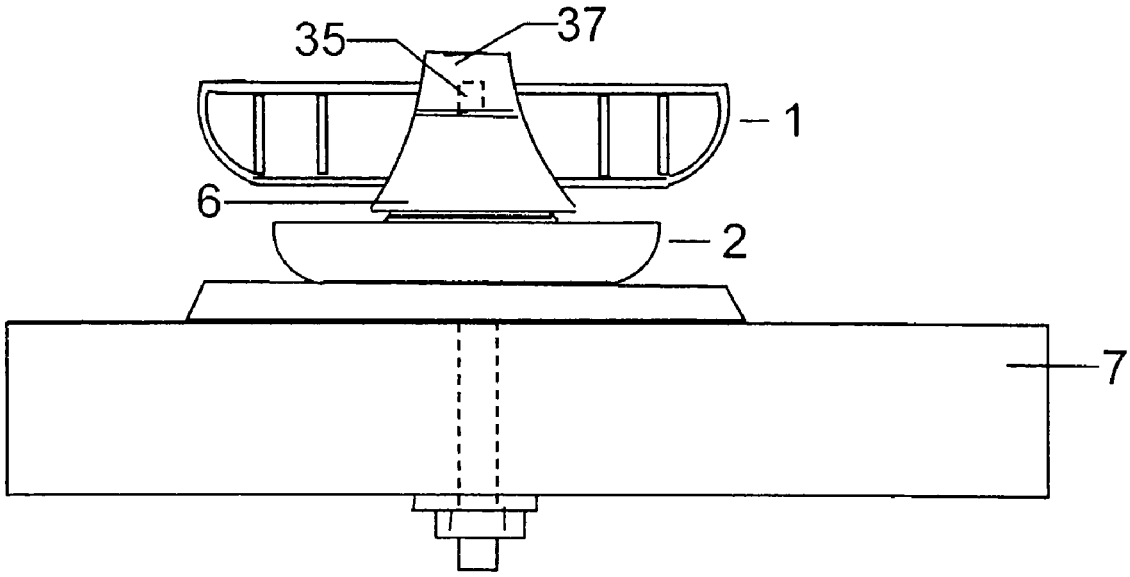

FIG. 2. is a front elevation of the embodiment shown in FIG. 1 and the sectional view of the fixed structure the unit is secured to. The soap container 1 is attached at one end of the telescoping arm 3 by means of an arm 6. The removable drain tray 2 is placed under the soap container 1.

Figure 3:
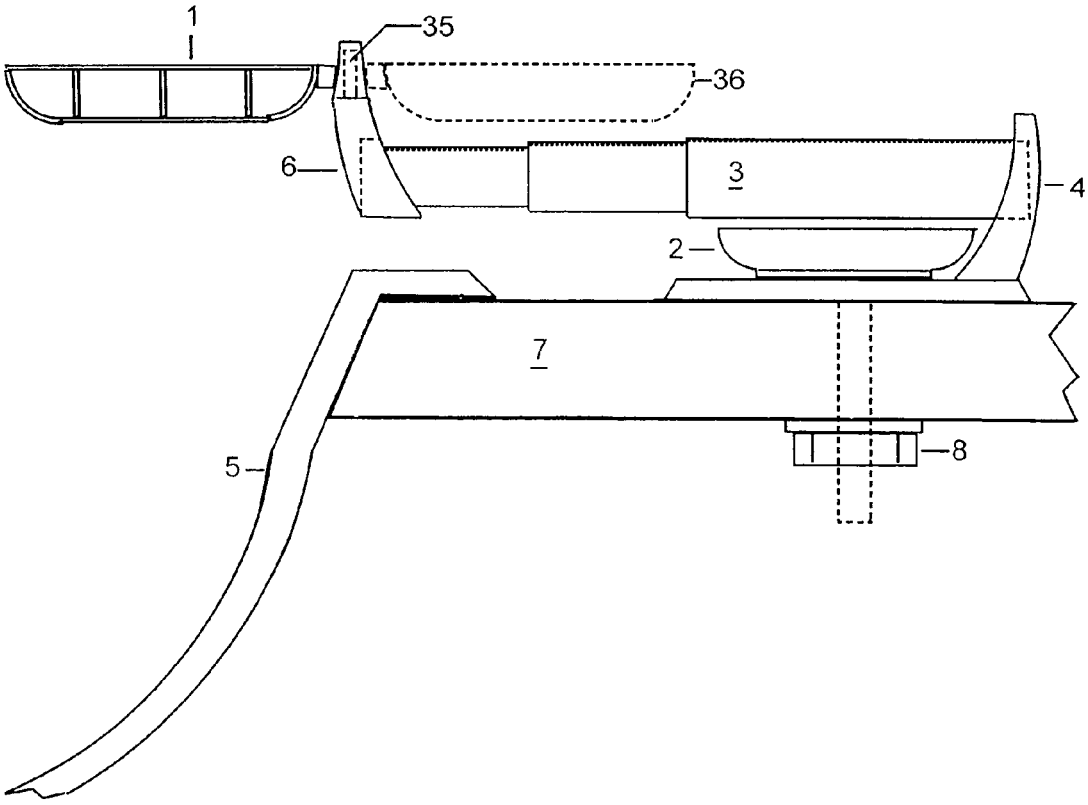

FIG. 3. shows side elevation as in FIG. 2 The telescoping arm 3 is extended and the soap container is then rotated 180° horizontally around the pivot 35, from the original position of the soap container which is represented by dotted lines 36 in FIG. 3, to the opposite side, placing the soap container 1 over the sink 5. In this position the water from the soap contained in the soap container 1 drains in to the sink 5. The water in the sink is drained through the sewer system and eliminated. Thus the absence of moisture caused from evaporating water, as such is the case in conventional soap dishes, which retain water in a lower level, combined with the open design construction of the soap dish, enables the soap to dry efficiently and quickly. The drain tray 2 does not move along with the soap container 1.

Figure 4:
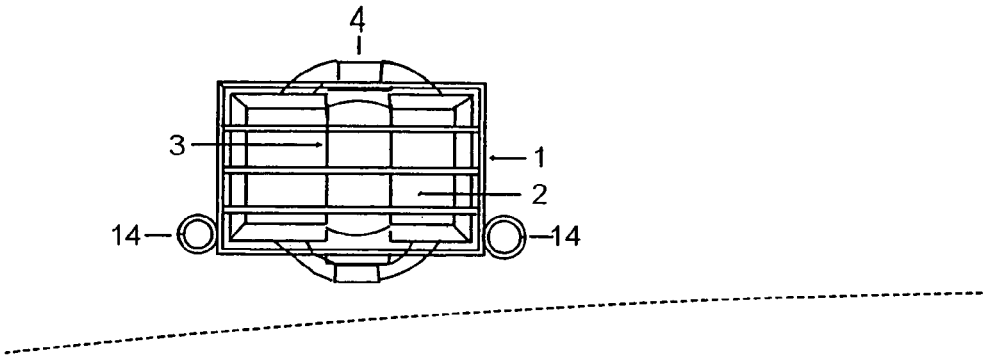

FIG. 4. Plan view shows the soap container 1 in its original position. Telescopic arm 3 and the drain tray 2 are visible through the soap dish.

Figure 5:
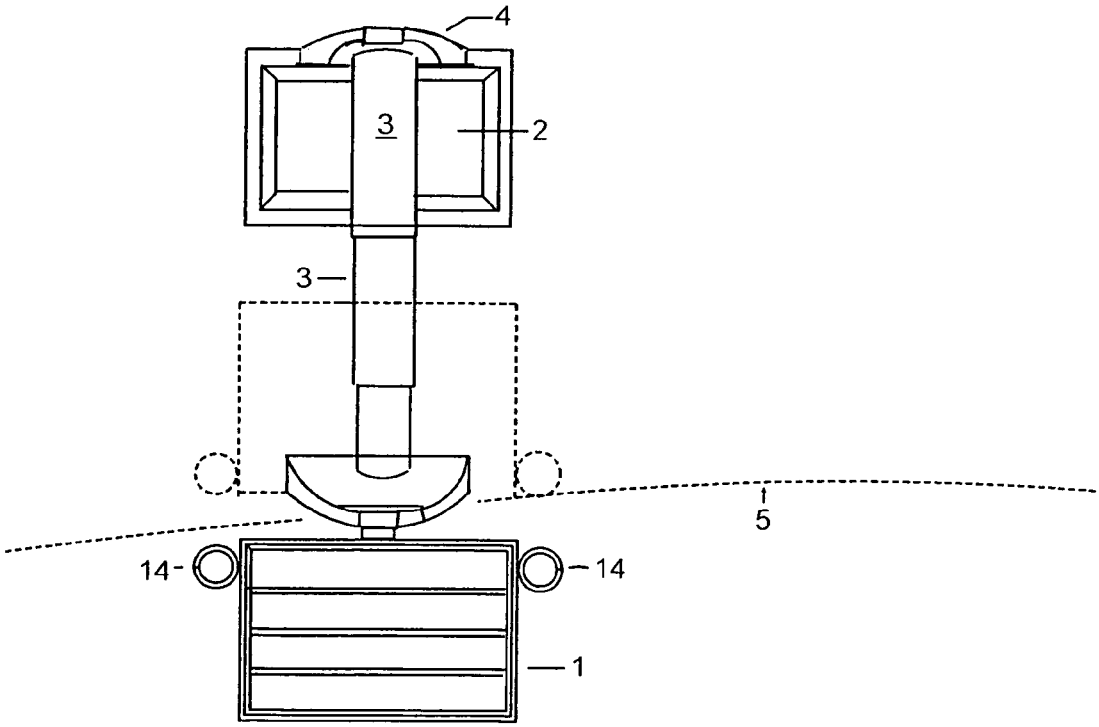

FIG. 5. is a plan view of the soap container with telescoping arm 3 extended out and the soap container rotated around the pivot, placing the soap container 1 over the sink. The edges of the sink are indicated by a dotted line 5 in the drawing. The attachment component 4 enables the soap container to be secured to other fixed structures 7. Two round brackets 14 are attached to the soap container to hold bath accessories such as tooth brush and razors, while these items are drying.

Figure 6:
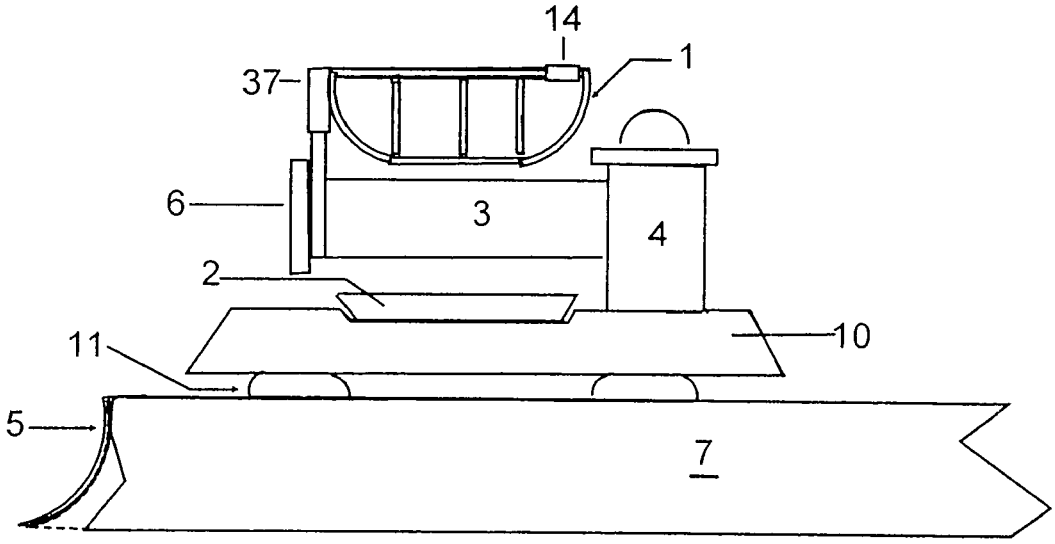

FIG. 6. is the side elevation of the modified form the embodiment which is free standing, and has different design of the attachment component. The soap container 1 unit described in FIGS. 1-5 is mounted on a heavily constructed base 10. The weight of the said base balances the weight of the soap and soap container when the telescoping arm is extended. Additional support is offered by means of, but not limited to suction cups 11 or adhesives.

Figure 7:
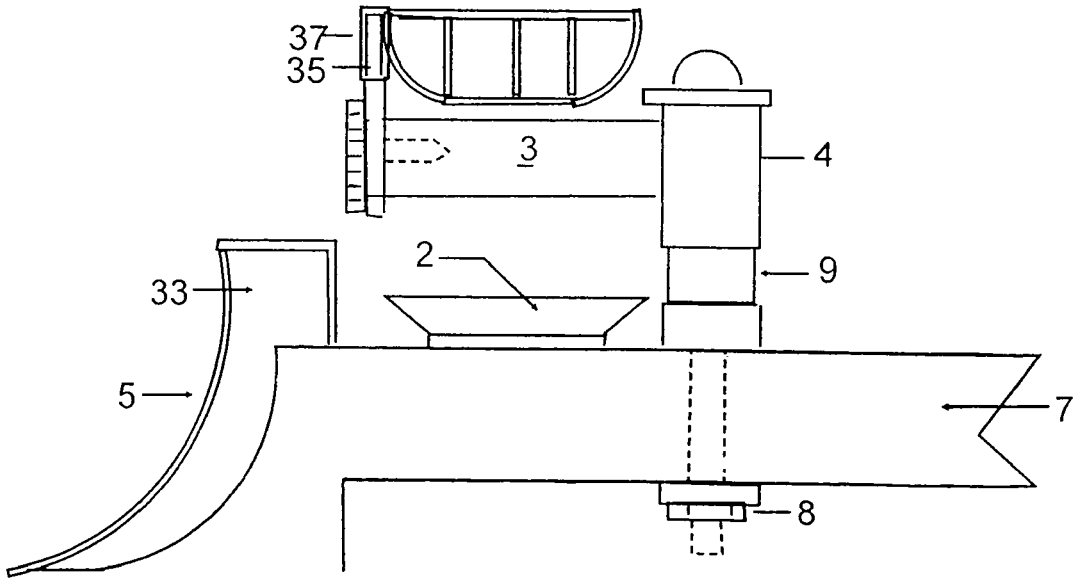

FIG. 7 is the side elevation of modified form. The rims of the sinks vary greatly in thickness. As there is no uniform or standard thickness of the said rims, the soap container has the ability to be raised to pass over wider sink rims 33. The soap container slides up and down over a cylinder 9. The soap container 1 and the telescoping arm 3 can be raised by pulling the attachment component 4 upwards.

Figure 8:
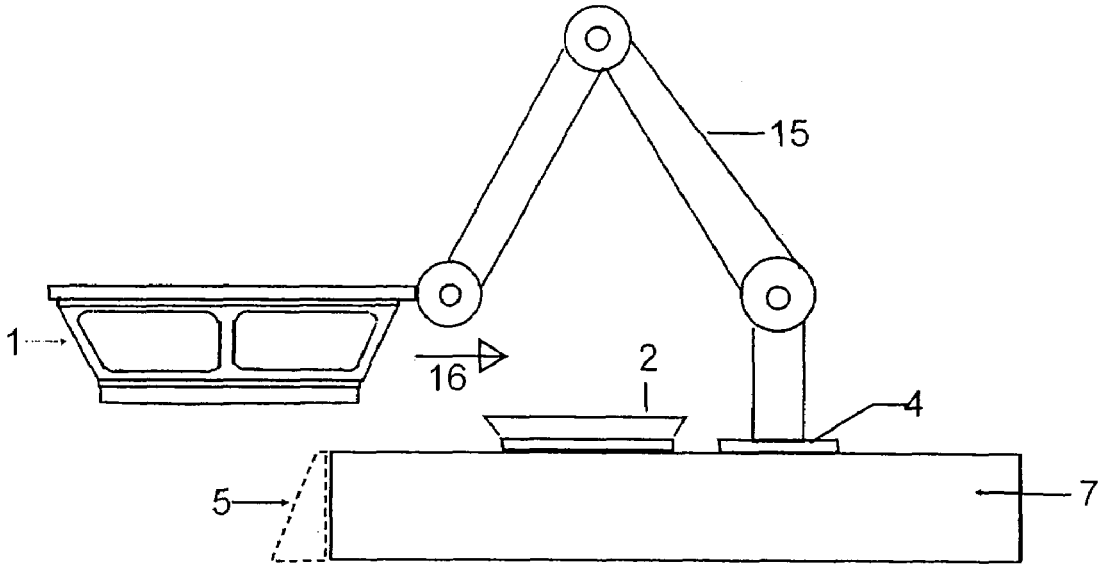

FIG. 8. Shows the side elevation of a modified form of the embodiment explained in FIGS. 1-5. A different design used around sinks which can be used to suit modern or contemporary décor. This design uses levers 15 positioned vertically, which enables the soap container 1 to be moved over the sink for water to drain from the soap in to the sink 5 and moved back to the original position, in the direction of the arrow marked as 16, to be placed directly over the drain tray 2.

Figure 9:
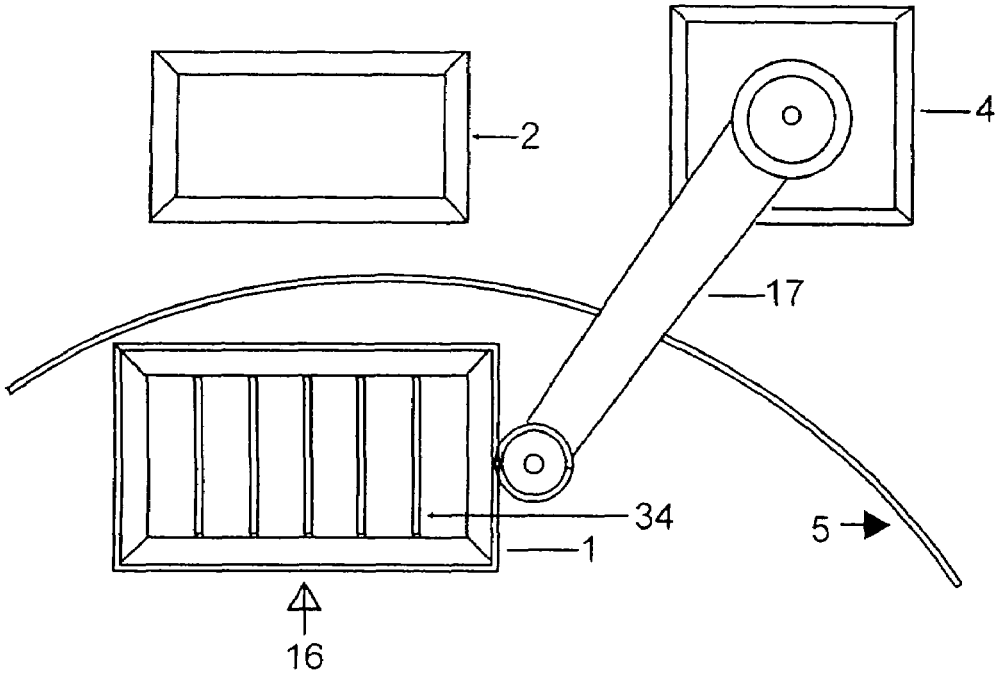

FIG. 9. Is the plan view of another modified form of designs where the soap container 1 is repositioned to and over the sink and back to the original position by means of an arm 17 which moves horizontally. In FIG. 9 the soap container 1 is shown placed over the sink 5, the part of the sink shown as a solid line 5. The soap dish can be moved back to the original position in the direction of the arrow marked as 16 which is directly over the removable drain tray 2. The rods in the soap container 34 are easily removed. By removing the rods in-between, the space between each rod can be increased. Fewer rods provide for fewer contact points with the wet soap which facilitates the soap to dry quicker, thus enhancing the drying function.

Figure 10:
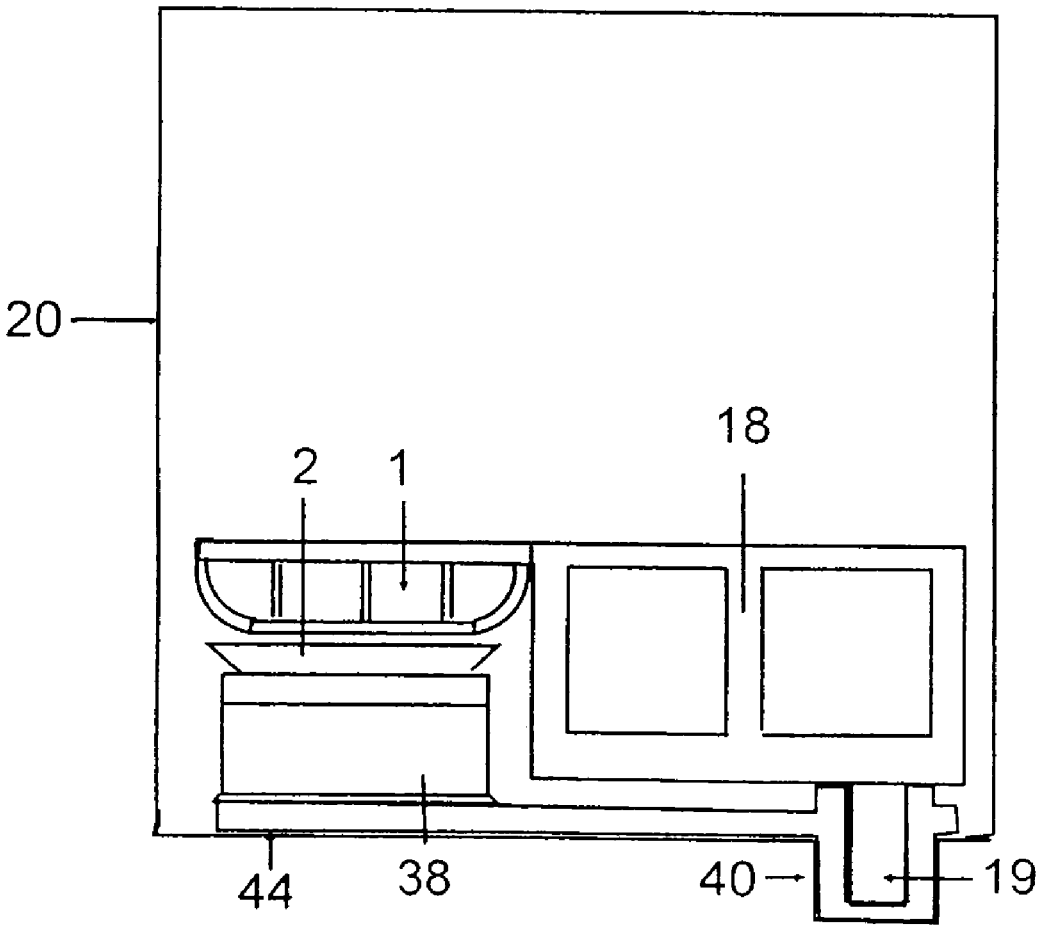

FIG. 10. is the front elevation of the modified form of the single embodiment self draining soap dish unit, which is designed to be used in other areas such as for shower enclosure. The self draining soap dish unit is designed to be set in a recess in the shower, which is 11" wide and 4¼" deep. This incorporates a variation in the securing component than that described in FIGS. 1-5. The soap container 1 is 1" high (deep), and the top surface (opening) is 4" long and 3" wide. The 4" long side of the soap container is attached to the top end of the 4" side of the accessory holder 18, which is a rectangular container 3" high, 5½ wide, and 4" deep. The pivot is attached to the bottom surface of the accessory holder. The center of the pivot is located at a point which is midway between the front and back sides of the accessory holder, which is 5½" long and 3" high and 4¼" farther from the side of the accessory holder that is attached to the soap container 1. The base is secured to a fixed surface inside a recess 20 in the shower area, using the attachment component 40, which is an integral part of the soap dish unit. The soap container can be rotated horizontally around this pivot. The soap container is rotated 90° along with the accessory holder and is brought out of the wall recess and placed directly over the shower floor. The water from the wet soap drains into the shower floor which in turn is drained through the sewer system. In this position, a container 38, 1½" high, 3½" wide and 3½" deep is placed under the soap container 1. The said container stores additional soap bar for later use as a convenience. The lid of this is fitted with a tray to contain water from the wet soap placed in soap container if the soap container is returned to this position before the soap dries. The lid of the container 38 and the tray are fabricated as one piece.

Figure 11:
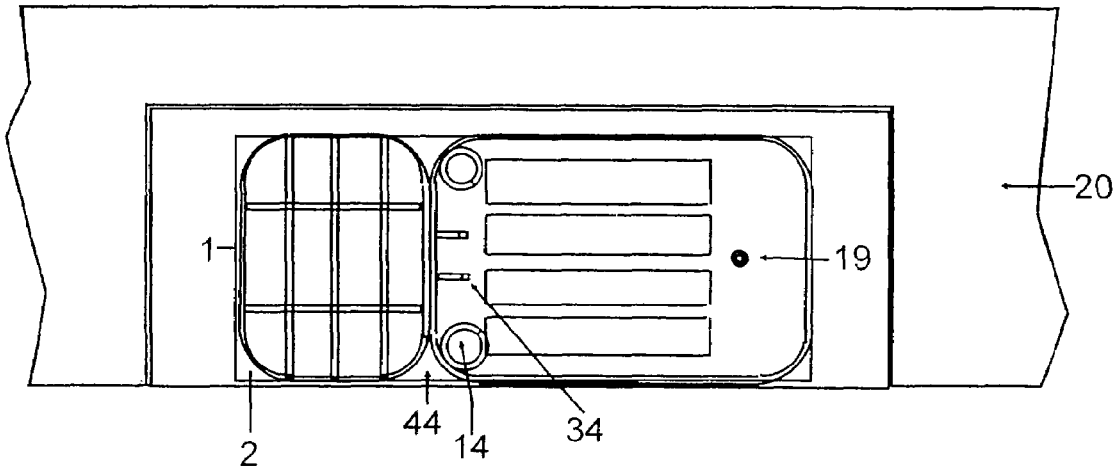

FIG. 11. Shows the plan view of the design in FIG. 10. The soap container 1 is in the recess 20 in the wall in the original position. The location of the pivot 19 in the floor of the accessory holder is at the farther end from the soap container.

Figure 12:
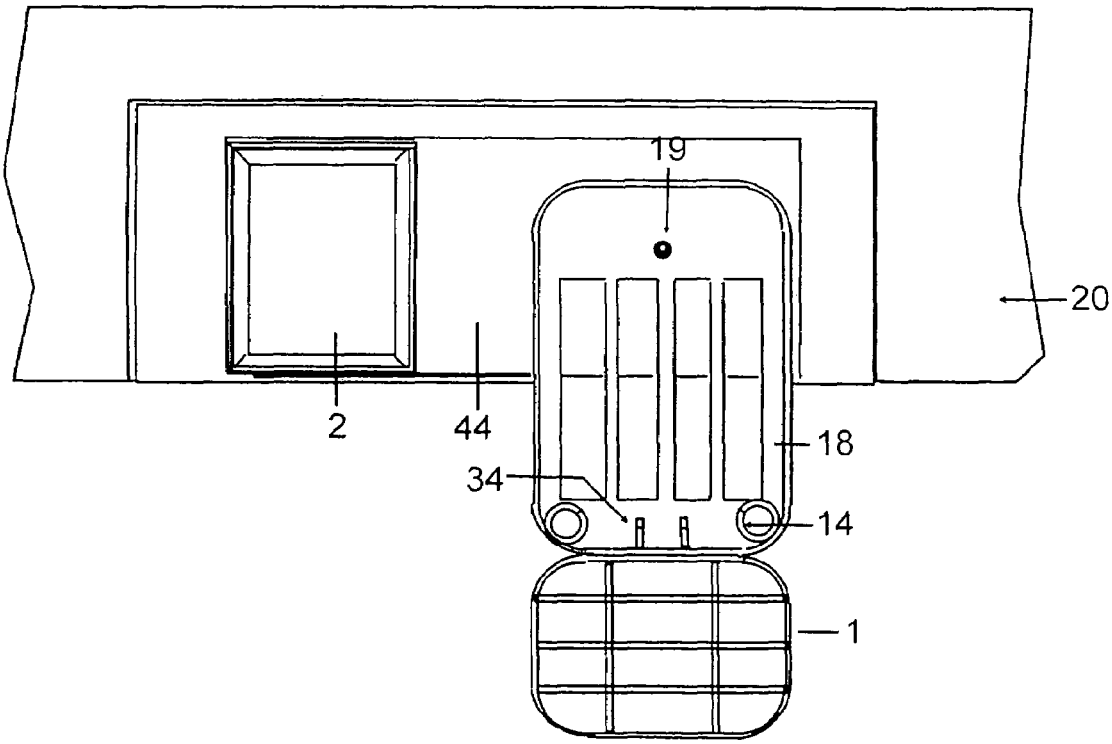

FIG. 12. Shows a plan view of FIG. 10 and FIG. 11. The soap container 1 is rotated horizontally 90° around the pivot 19, out of the shower recess 20 and is placed over the floor of the shower. The self-draining soap dish unit has an open design with only a few contact points with the soaps placed in the soap container 1. The drain tray 2 collects any water draining from the wet soap contained in the soap dish, if and when the soap container is pushed back to its original position before the soap is dry. The accessory holder 18 is a container that holds bath accessories such as shampoo, conditioner etc. The accessory holder has two round brackets 14 to hold tooth brushes and a pair of hooks 34 to hold razors. The accessory holder also has open design on all sides for the water to drain in to the shower floor and the contents well aerated to dry faster. The water from the soap container drains into the shower floor and in turn drains into the sewer system and eliminated.

FIG. 13-FIG. 16. Show details of a modified form of the self-draining soap dish unit, used in a pre existing standard recess opening in shower enclosures.

Figure 13:
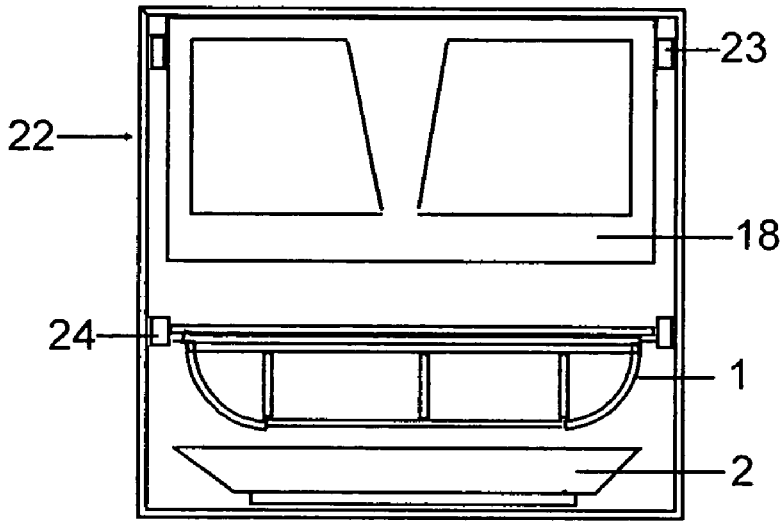

FIG. 13 is the front elevation of a modified form of the self-raining soap dish unit in a pre existing standard recess opening in shower enclosures, designed to fit smaller wall recess 20. The soap container 1 is placed over a drain tray 2 on the lower part of the casing 22 which can be slid out of the wall recess area and the casing, repositioned to the shower floor using a sliding mechanism 24. The accessory holder is placed in the casing upside down (inverted).

Figure 14:
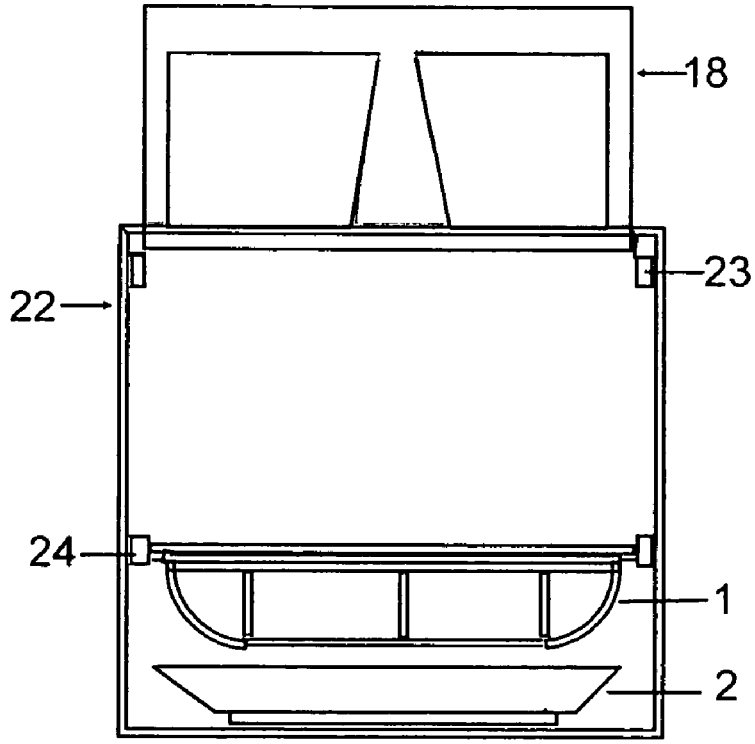

FIG. 14. is a front elevation of a modified form used in a standard recess opening for self-draining soap dish unit. The accessory holder 18 is pulled out and rotated around the pivot 26 FIG. 16, placing the accessory holder facing upwards, so that the bath items such as shampoo can be stored.

Figure 15:
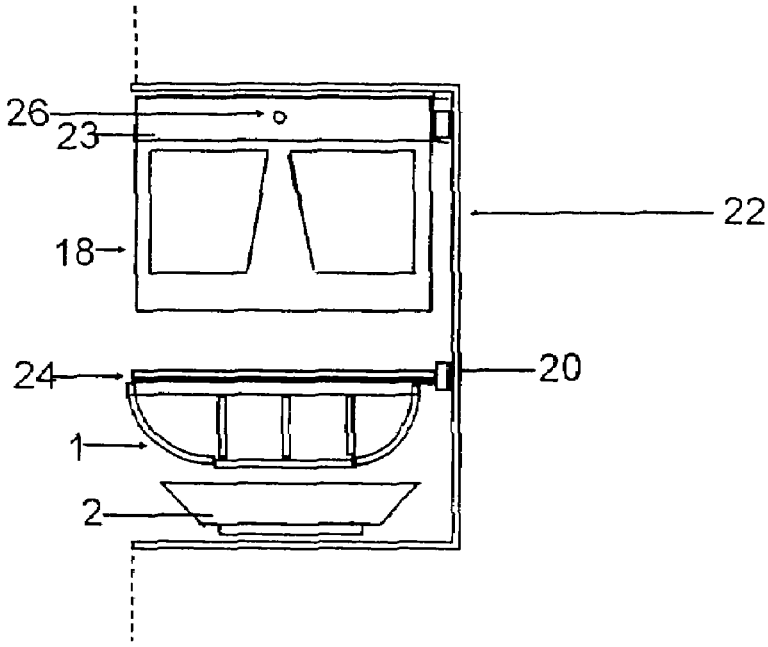

FIG. 15. is the side elevation of the mechanism of the modified form of the self-draining soap dish unit as shown in FIGS. 13 and 14. The accessory holder 18 is contained in a casing 22. The unit is set in the wall recess 20, cross section shown. The accessory holder is attached to the sliding mechanism 23 with the pivot 26 on both sides of the accessory holder (Only one side shown in the drawing). The soap container 1 in the original position placed over the tray 2 and contained inside the casing 22.

Figure 16:
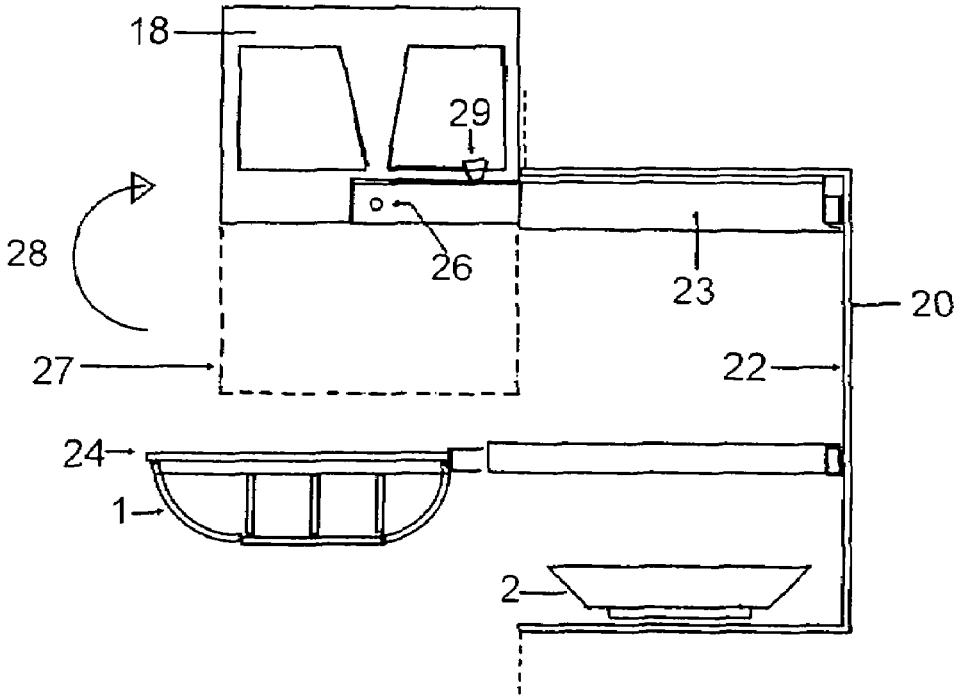

FIG. 16. is a side elevation of a modified form of the self-draining soap dish unit in a pre existing standard recess opening, which displays the soap container 1 and accessory holder 18 arms extended out. The accessory holder is moved out to the position as indicated by the dotted line 27. The accessory holder is moved with the mechanism that extends out 23. The accessory holder is then rotated 90° clockwise horizontally around the two pivots 26 on either side of the accessory holder. This brings the accessory holder to the up right position rendering it functional and to hold bath accessories such as shampoo. This is locked in position with a latch 29 on both sides of the accessory holder. The soap container 1 is extended out of the casing 22 and hence the wall recess 20 using the arm mechanism 24. The water from the soap dish drains into the shower floor and is drained through the sewer system, eliminating moisture. The tray 2 stays in original position.

Figure 17:
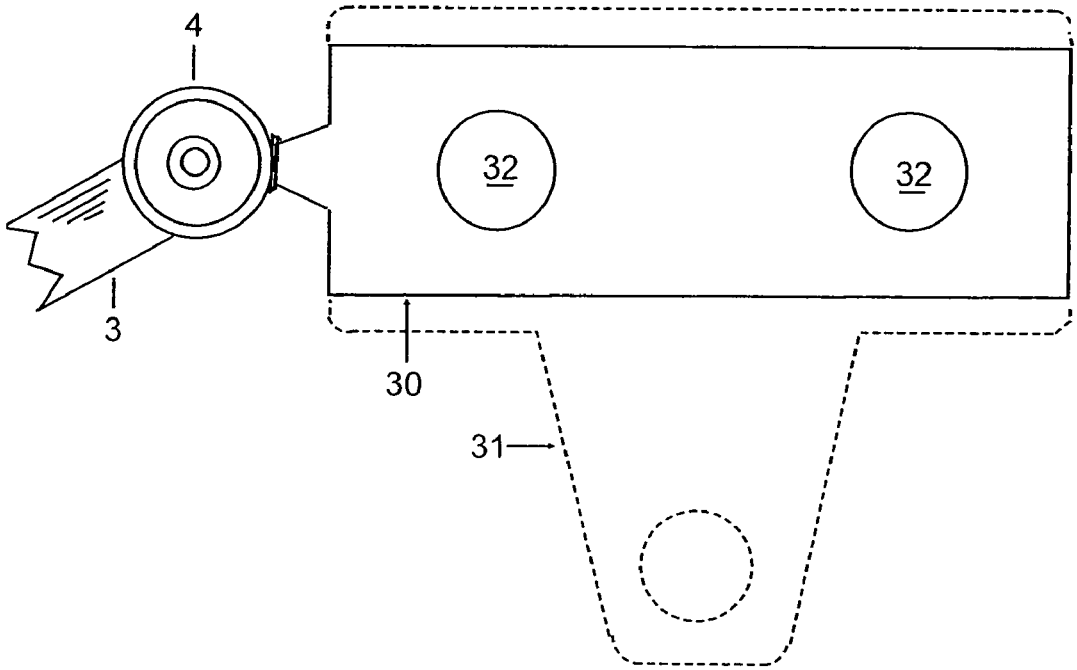

FIG. 17. Shows the details of the plate 30 (modified form) which can secure the modified self-draining soap dish unit shown in FIG. 7 to a fixed structure (sink/vanity top) with out the necessity of requiring separate holes drilled for this purposes. The plate 30 is secured using the pre existing holes of the faucet, by sandwiching the plate between the faucet and the fixed structure (sink/vanity top).

Figure 18:
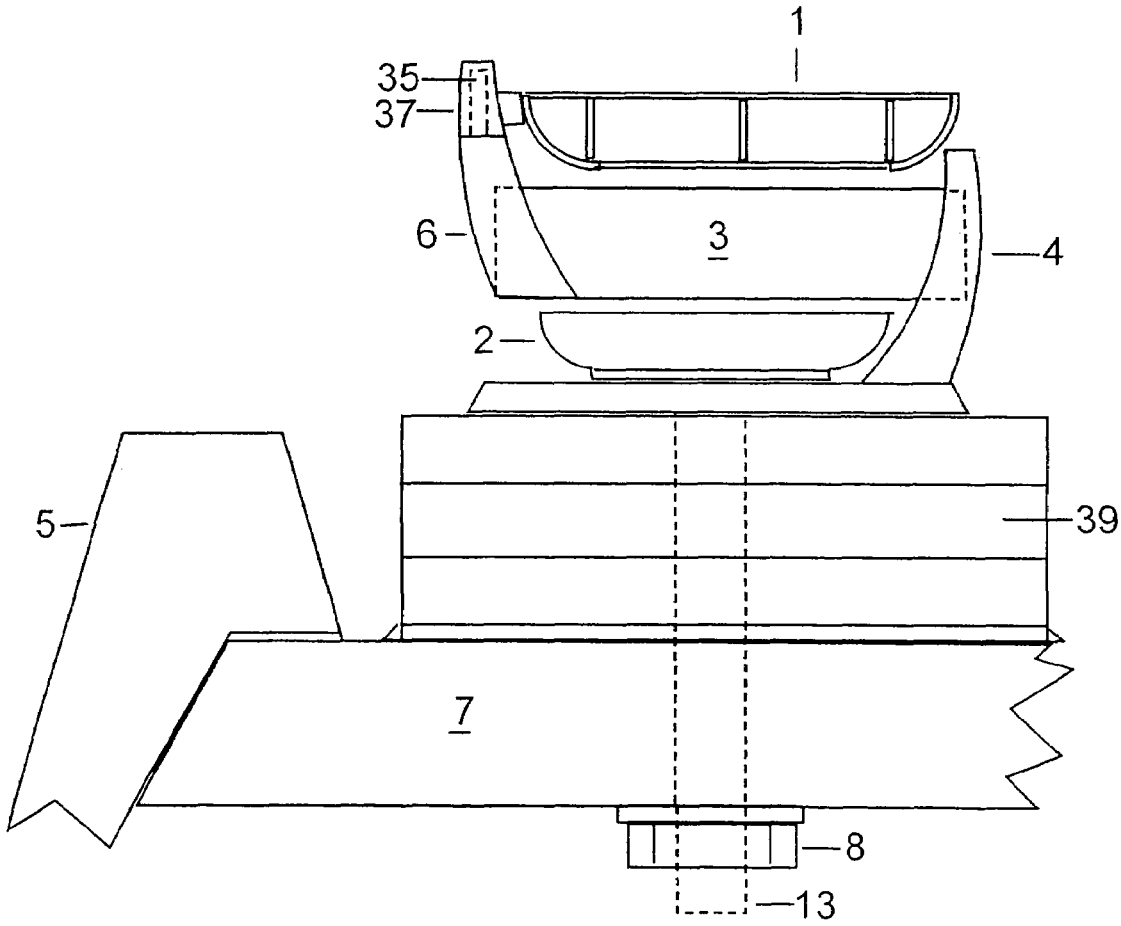

FIG. 18 explains the use of stackable base units 39, usable in the embodiment (FIGS. 1-5) to increase the height of the self-draining soap dish unit to pass over thicker rims of the sink. These bases are fabricated in ¼" and ½" heights. The desired height is achieved by stacking appropriate number of the said base units over the decorative base 41.

FIGS. 19-22 describes simplified and modified forms of the self-draining soap dish unit illustrated in FIGS. 13-16.

Figure 19:
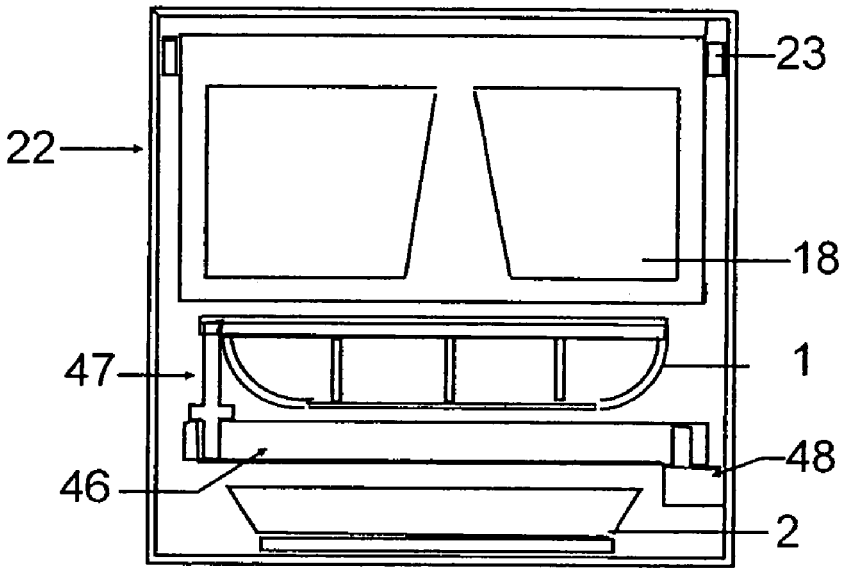

FIG. 19 is the front elevation. The drawing shows the accessory holder 18, the soap container 1 and the tray set in the casing 22.

Figure 20:
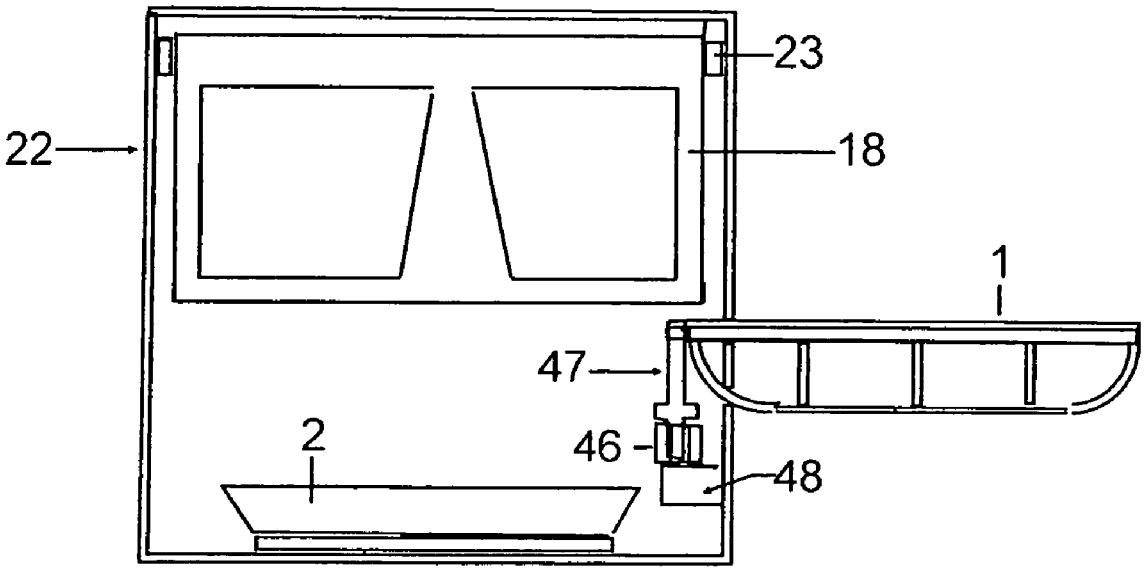

FIG. 20 shows the front elevation. The soap container as shown moved out of the casing and placed over to the side of the casing. This is accomplished by the leaver 46 rotating 90° around the pivot 48 and rotating the soap dish 90° to place it in the position shown. The water contained in the soap container drains in to the desired area such as the floor of the sink. The accessory holder 18 is pulled out of the casing 22 and bath accessories can be stored in the accessory holder. A drain tray 2 is placed underneath the soap container.

Figure 21:
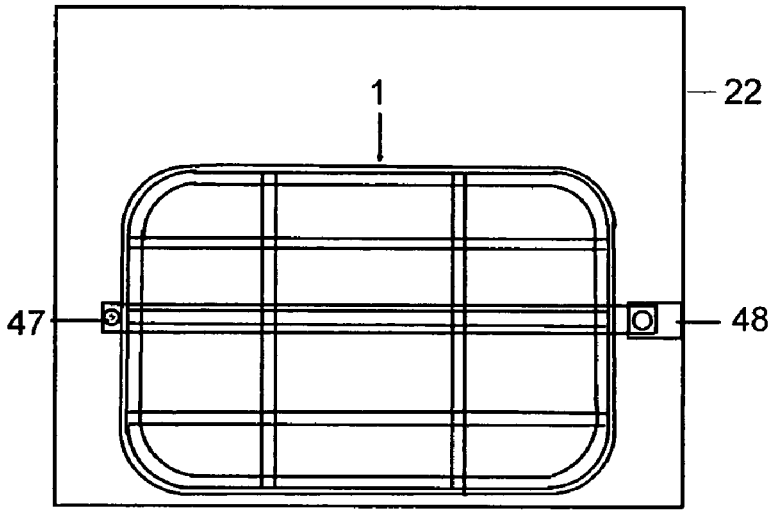

FIG. 21 is the horizontal sectional plan view above the soap container 1 shown illustrating the soap dish movement mechanism.

Figure 22:
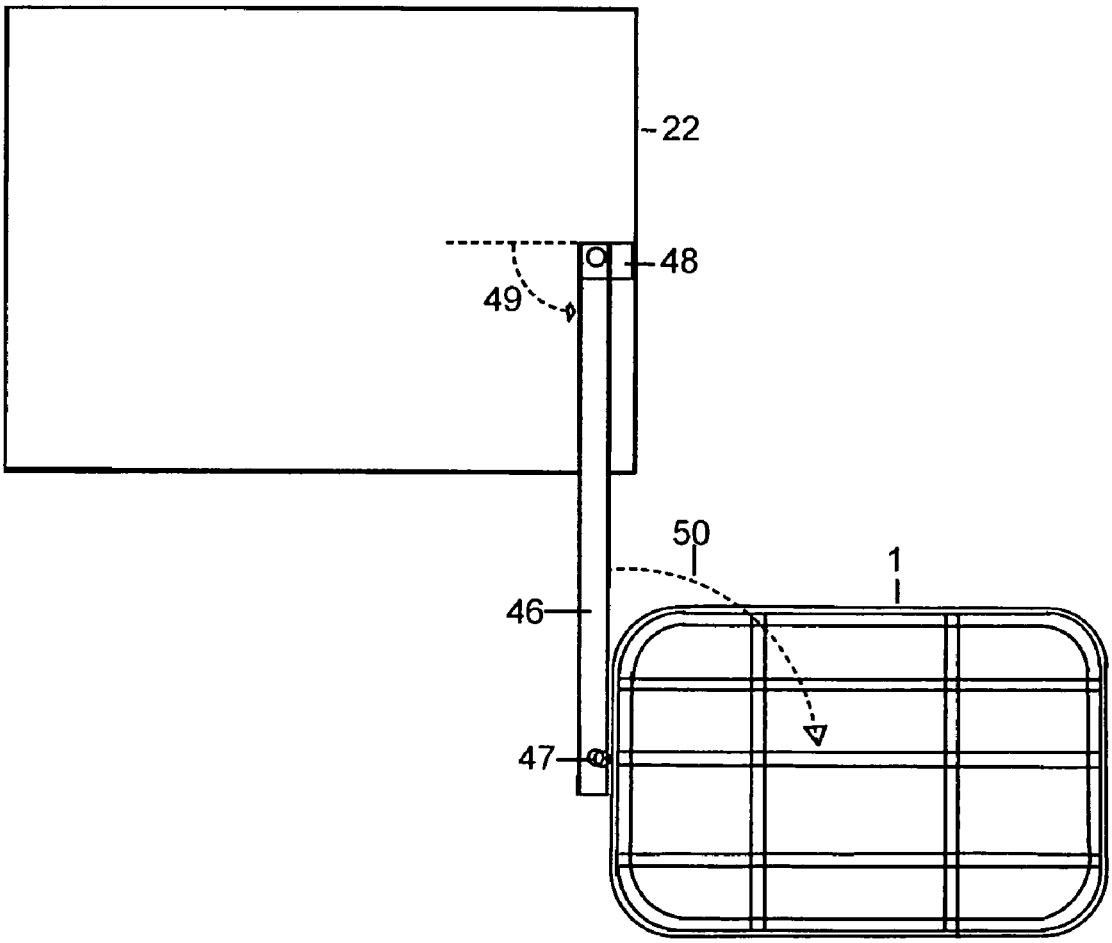

FIG. 22 Show the horizontal sectional plan view as in FIG. 21. Here the soap dish is shown in the functional position. The leaver 46 is shown rotated around the pivot 48 in the direction of the arrow marked as 49. The soap container 1 rotates in the direction of the arrow, around the pivot 47 marked by the arrow 50.

DETAILED DESCRIPTION OF THE INVENTION

The field of the invention relates to a novel concept of a single embodiment, namely a self-draining soapdish unit fabricated with choice of materials, metals, sizes, shapes, styles, including the options for accessories, securable to fixed structure or free standing, in which the soap held in the container component of the unit can be repositioned, by means of one or more integrated mechanisms, such as telescopic arm, pivoted leaver, hydraulic, hinge, pneumatic, motor, solenoids, springs and inclined plane, to a preferred location, such as sink, tub or shower floor, to enhance drying function of the soap, during use and thereafter, allowing water from the wet soap to drain into the preferred area and be eliminated, thus drying the soap effectively and efficiently, and is then returned to its original position in the soapdish, without compromising appearance. In addition to the soap, the current invention incorporates provisions to dry and/or store other bath accessories such as soap, shampoo, toothbrush and razors, thus enhancing the utility, appeal and its suitability for diverse needs and decors. The combined structural construction and functional elements of this single embodiment to enhance and maximize the drying feature of the soap makes this soapdish unit, unique and innovative.

As one of the intended uses of this embodiment is in homes, it is of prime importance that this unit is designed to suit various styles to match different construction details and decors used in the homes. This requirement is accomplished as the design concept is amenable to variability of (a) mechanism for repositioning the soap container component of the unit, by means of one or more integrated mechanisms, such as, but not limited to, telescopic arm, pivoted leaver, hydraulic, hinge, pneumatic, motor, solenoids, springs and inclined plane; (b) securable to other fixed structures such as counter tops, wall recess or free standing, removable unit, with a heavy base to balance the weight of the soap and soapdish by using suction cups or adhesive for additional support (c) location of use such as in showers, other sinks or tubs, chosen by the individual user, based on factors such as safety, convenience and function; (d) various soap container shapes, sizes, materials, and metals, and in addition to (e) incorporating provisions to store accessories such as shampoo, toothbrush thus enhancing, in addition to the drying feature, the utility, appeal and its suitability for diverse needs and decors.

It is a well known fact that people in general relate well to familiar objects and tend to use them. The soap container component of the embodiment with the repositioning element can be moved back to the original position and in this position the soap dish unit appears similar to a more familiar conventional soap dish and the repositioning mechanisms are inconspicuous. This invention has an yet an another novel advantage that this soap dish can also be used as a regular soap dish in its original position, water draining into the removable drain tray which is placed underneath the soap container, when and if desired so.

The use of this embodiment is not limited to sinks, tubs and showers, the other applications include but not limited to, use in commercial, hospitals restaurants and other public and private areas. It is also understood that the invention defined by the appended claims is not to be limited to particular details set forth in the following description, as many apparent modifications are possible with out departing from the basic element and scope of the present invention.

The embodiment and the modified forms are comprised of four basic components. The soap dish consisting of the soap container which holds a bar of soap and the drain tray, the repositioning element that enables the movement referred hereafter as repositioning-mechanism; the component that secures the other components in position and in turn secures all the components to a fixed structure, referred hereafter as the attachment component; the part or casing that holds the other components to store bath accessories such as shampoo and provisions to hold items such as tooth brush and razors which is referred hereafter as accessory holder. The soap dish, the movement mechanism, the attachment component along with or with out the accessory holder together form the single embodiment, namely "the self-draining soap dish unit".

In the following sections, the prototype model of this self draining soap dish unit used in sink application is described in detail (FIGS. 1-5). Following this, various modified forms along with the rationale of these modifications of the prototype self-draining soap dish unit are described. (FIGS. 6-18).

The prototype self-draining soap dish unit which is referred to as the embodiment contains 1, standard size soap dish, which is 2½" wide, 3½" long and ⅝" deep. The soap dish is engineered such that only a few contact points in the soap dish will touch the soap, making this a more open design on all sides for the water to drain easily and the soap to be aerated well to dry more effectively and efficiently. The soap dish is constructed of metals or material which resists tarnish and corrosion caused from constant exposure of moisture. The body of the soap dish is constructed of stainless steel or other suitable materials, with rods which are round, triangular and rectangular in cross section. The rods on the bottom of the soap dish are spaced ½" to 34" apart. The self-draining soap dish unit contains a drain tray which measures 3¾" long 2¼" wide and 12" deep and is designed to fit under the soap container, in the retracted (original) position, to collect any additional water and soap debris, if the soap dish is returned to the original position and if the soap is still wet. The soap container part of the self-draining soap dish unit is constructed in different sizes to accommodate various sizes of soap bars and constrains of the space available due to varied sizes and shapes of sink available. The soap container (1) can be easily disconnected from the unit at the pivot 35 by pulling the soap container (1) upwards and away from the pivot, thus facilitating interchanging of different sizes of the soap container to suit the above described needs.

The soap container is attached to the outer end of the inner most arm of the telescoping arm 3. The soap container is attached to the part that contains the section 37 which fits over the pivot 35 which in turn is an extension of the arm 6. This arm 6 secures the soap container to the telescoping arm. The said part that contains the female attachment 37 fits over the arm 6 and combines to form one continuous, artistically designed form as shown in FIG. 1. This form has the same dimension and shape as the arm 4. The soap container is designed to rotate horizontally around this pivot 35.

The telescoping arm is 3¼" to 3½" long in the retracted position and comprised of three cylindrical reciprocating arms. The outer most arm is less than ¾" in diameter, and when fully extended it reaches 8¼". The telescoping arm is engineered to be of lighter in weight, and fabricated with materials to resist tarnish due to constant moist condition and to bear the forces exerted during the intended use. This said pivot is secured by means of artistically designed arm 6 to the telescoping arm, which enables the soap dish to be moved over the sink 5 for use and the soap contained in the soap container 1 to drain water into the sink 5 (section of the sink shown) and the soap dish to be moved back to the position where it was moved from, the original position.

The telescoping arm 3 is secured to a base 42 which has a rectangular surface 4" wide and 3" deep and ¼" high. This has inundations for the drain tray to be placed in the correct position.

The bottom part of this base is fitted with securing components to enable the unit to be secured to other fixed structures for stability during the operations of the soap container 1, when the soap dish containing the soap is extended out and to compensate the forces caused due to the shift of weight and hence the shift of the center of gravity.

For when the soap dish is in use and when the soap is drying, the soap dish (1) is moved over the sink 5. This movement is accomplished by the extension of the telescoping arm 3 as shown in FIG. 3, and then the soap container 1 is rotated 180° around the pivot 35 on a horizontal plane from its original position as designated by the dotted line 36 FIG. 3 to place the soap container on the opposite side, and thus placing the soap container over the sink. Rotating the soap container provides the additional reach to and over the sink. This enables the use of a smaller telescoping arm with only three reciprocating arms. Additionally, moving the soap container from being over the extended telescoping arms prevents the soap scum and derbies falling over the telescoping arm and hampering the proper function.

The mechanisms which enables the placement of the soap container 1 over the sink allows the water from the wet soap to drain directly into the sink, eliminates the soap bar from being in direct contact with water, and eliminates evaporated moisture, as there is no water retained underneath the soap as in conventional soap dishes. The water drains in to the sink 5 and is drained out through the sewer system and eliminated. The lack of moisture, the absence of direct contact of the soap with water and the open design of the soap container combined make it the best possible condition for the soap bar to dry.

The above prototype self-draining soap dish unit design is amenable to be crafted in various designs and sizes to suit areas, space availability, user convenience, designs, textures, materials, shapes, size, and colors to suit décor, economics or the areas where they would be installed.

The self draining soap dish unit can be designed to be of interchangeable sizes of soap dishes and to accommodate different sizes of bars of soap and constrain of space available due to different size of sink. The self-draining soap dish unit is amenable to be made with open designs in all or with many sides as possible, design permitting, to enable the soap to dry more efficiently and effectively. In certain designs of the modified form, the rods at the bottom of the soap dish in FIG. 9 can be made with an option for the rods to be removed. Removing some of the rods in between will increase the space between the rods. With fewer rods and wider spaces between the rods and thus fewer contact points between the soap and the rods, will enable the soaps to dry more efficiently.

The novel element in the self-draining soap dish unit design specifically includes a telescopic and pivotal repositioning mechanism which will enable the soap container to be drawn into the desired area for use and drainage of water from a wet soap placed in the soap dish while the soap is drying. Such a mechanism will enable the soap container to be moved back from extended, functional to original position to ensure décor and safety and not compromise appearance.

In modified forms of the said repositioning mechanism, this can also be accomplished by one or more mechanisms such as telescopic arm, pivoted leaver, hydraulic, hinge, pneumatic, motor, solenoids, springs and inclined plane. The choice of the said mechanical device is governed by design and style requirements and thus will be determined based on factors such as size of sink, space available, convenience of the user, function and design to match décor and styles (Traditional, contemporary, country, etc).

The soap container 1 has provisions such as round brackets 14 and L-shaped hooks 34 to hold tooth brushes and razors while these items are drying. The items, tooth brush and razors have to be removed from the soap container before the soap dish can be returned to the original position.

In modified version of the said attachment components, the soap container and the repositioning mechanism can also be attached together and in turn be able be secured to a base of a free standing unit or secured to a fixed structure using a component designed to complement the various designs and styles of the other components. The self-draining soap dish unit securing mechanism is amenable to be in-built and to be secured to other fixed structures such as counter tops, wall recess or installations can be achieved by attachment mechanisms. The attachment mechanism can or in part is in the form of a casing. These can, in addition be free standing, removable unit, with heavy base to balance the weight of the soap and soap dish with suction or adhesive (tape) additional support during use. This attachment can also be secured using existing holes made for a faucet by using the special plate, FIG. 17. This prevents from requiring drilling additional holes in the sink or counter top.

In order to explain the novel elements, and to describe the versatility of this self-draining soap dish unit that is amenable to be adapted to various decors, styles and applications, specific details of some of these modified forms are described below.

The utility of the embodiment illustrated in FIGS. 1-5 can be expanded by the following modification. Sinks in general are made of various designs and as a result, the rims of the sinks come in different thickness. To make provision to adapt to these variations in height, modifications are made by increasing the height of the base of the embodiment, using devices such as stackable units 39 FIG. 18 of various sizes and shapes, which can store accessories such as extra soaps, razors, and by stacking appropriate numbers of these stackable containers over the base unit 41 to achieve the height desired, to enable the soap container to pass over the thicker rims of the sink. These bases are fabricated in varying heights.

A modified form of the embodiment illustrated in FIGS. 1-5 is constructed as a free standing unit for additional utility. The side elevation of the modified form of the embodiment which is free standing is shown in FIG. 6. The self-draining soap dish unit described in FIG. 6 has a different attachment component and is mounted on a heavily constructed base 10. The weight of the base balances the weight of the soap and soap dish when the telescoping arm is extended. Additional support is offered by means of suction cups 11 or adhesive.

The rims of the sinks vary greatly in thickness. As there is no uniform or standard thickness of the said rims, the modified design of the soap container in FIG. 7 with same features as shown in FIG. 6 has the ability to be raised to pass over wider sink rims 33 soap dish slides up and down over a cylinder 9. The soap container 1 and the telescoping arm 3 can be raised by pulling the attachment mechanism 4 upwards.

Modified form of the said embodiment in FIGS. 1-5 are designed with various other mechanisms and soap dish styles and design to suit different styles and décor. Two such examples of designs are described in FIGS. 8 and 9. In FIG. 8, the side elevation of a modified form of the prototype embodiment as is described in FIGS. 1-5. A different design used around sinks which can be used to suit modern or contemporary décor. This design uses levers positioned in a vertical plane, enables the soap container 1 to be repositioned over the sink for water to drain from the soap in to the sink 5 and moved back to the original position, in the direction the arrow marked as 16 is placed directly over the drain tray.

Another variation in mechanism for repositioning the soap container is described FIG. 9, which is a modified form of design where the soap container 1 is moved to and over the sink and back to the original position by means of an arm 17 which moves in a horizontal plane. In FIG. 9 the soap container 1 is shown placed over the sink 5, the part of the sink shown as a solid line 5. The soap container can be moved back to the original position in the direction of the arrow marked as 16 which is directly over the removable drain pan 2.

FIG. 17 Shows the details of the plate 30 (modified form) which can secure the modified self-draining soap dish unit shown in FIG. 7 to a fixed structure (counter/vanity top) with out the necessity of requiring separate holes drilled for this purposes. The plate 30 is secured using the pre existing holes of the faucet, by sandwiching the plate between the faucet and the fixed structure.

One of the other main intended uses of the self draining soap dish unit is in the shower enclosure and tubs. The utility of this modified design is enhanced by incorporating other amenities to the basic soap dish design such as containers to hold bath accessories such as shampoo and conditioner, and a separate container that can store an additional soap bar in a dry environment for future use. FIGS. 10-12 explains details of such modified embodiment used in shower enclosure recess which is 4¼" deep, 11" wide and 11" high. The minimum height required is 5". The height of the recess is in fact determined on individual basics, depending on the height of the accessories that needs to be stored in the accessory container.

This modified form of the self-draining soap dish unit is designed to be set in a recess in the shower, which are 11" wide and 4¼" deep and a minimum of 5" high. This soap dish unit incorporates different mechanism than the mechanism as described in the embodiment in FIGS. 1-5. The soap container 1 is 1" high (deep), and the top surface is 4" long and 3" wide. The corners of the sides of the soap dish are rounded. The 4" long side of the soap dish is attached to the top margin of the side of the accessory holder 18, which is a rectangular container 3" high, 5½ wide, and 4" deep. The corners in between the sides of the accessory holder are rounded, particularly the corners close to the pivot 19 as this enables the unit to rotate with a minimum of 4⅛" depth of the recess. The pivot is attached to the bottom surface of the accessory holder. The center of the pivot is located at a point which is midway between the front and back sides of the accessory holder, which is 5½" long and 3" high and 4¼" farther from the side of the accessory holder that is attached to the soap container 1. The pivot which is attached to the accessory holder is cylindrical in shape with ½" diameter and is 1½" long. The pivot 19 is machined to fit precisely into the female counterpart 40 which is an integral part of the base 44 of the soap dish unit and forms the attachment mechanism. The length and breadth of the base 44 of this unit is the same as the over all combined length and breadth of the soap container 1 and accessory holder 18. The component of the base of the self-draining soap dish unit into which the pivot fits 19 is the integral part of the said base 40. The said base has an attachment mechanism which is a cylinder of 1" in diameter and 1¾" long and positioned vertically as an integral part of the base. The center of this cylinder aligns with the center of the pivot cylinder attached to the bottom of the accessory holder 18. The top side of the cylinder which is attached to base is set ⅛" higher than the top surface of the base, this prevents the water from seeping in to the pivot mechanism. The cylinder which is attached to the base has a hole precisely drilled ½" in diameter and 1⅛" deep for the pivot to fit precisely yet allow the soap dish to swirl around the axis on a horizontal plane. The base is secured to a fixed surface inside a recess 20 in the shower area, using the base 40 of the attachment component. The base 40 has indentations for the soap container 38 to be placed in the correct position. The soap container can be rotated horizontally around this pivot. The soap container along with the accessory holder 19 is rotated 90° and is brought out of the wall recess and placed directly over the shower floor. The water from the wet soap contained in the soap dish container drains into the shower floor which in turn is drained through the sewer system. In this position, a container 38 1½" high, 3½" wide and 3½" deep is placed under the soap container 1. The said container stores additional soap bar for future use as a convenience. The lid of this container is fitted with a tray to contain water from the wet soap placed in soap dish if the soap dish is returned to this position before the soap dries. Thus the lid of the container 38 and the tray is fabricated as one piece.

When the soap container is not in use and when and if the soap is dry the soap container is neatly tucked inside the recess. During use and until the soap is dry the soap container 1 is brought out of the recess for the water to drain in to shower floor.

In the FIG. 12, which is the plan view of FIG. 10 and FIG. 11 the soap container 1 is rotated horizontally 90° around the pivot 19, out of the shower recess 20 and is placed over the floor of the shower. The soap dish has an open design with only a few contact points with the soaps placed on the soap container 1. The drain tray collects any water draining from the wet soap contained in the soap container, if and when the soap container is pushed back to its original position before the soap is dry. The accessory holder 18 is a container that holds bath accessories such as shampoo, conditioner etc. The accessory holder has two round brackets 14 to hold tooth brushes and a pair of hooks 34 to hold razors. The accessory holder also has open design on all sides for the water to drain in to the shower floor and the contents well aerated to dry faster. The water from the soap container drains into shower floor in turn drains into the sewer system and eliminated.

Yet another modified form of the embodiment is used in situation where it is necessary to utilize pre existing standard recess which is smaller in size. The details of the modified form of the soap dish, which is 5" high, 5" long and 3½ to 4" deep, used in the said pre existing standard recess opening in shower enclosures is described in FIG. 13-16. The soap container 1 and the accessory holder 18 are stored in the original position inside the casing 22 when not in use and if and when the soap is dry. In this unit, the accessory holder is non functional in this original position as the accessory holder is placed upside down, and so bath accessories cannot be stored.

The self-draining soap dish unit uses a pre existing standard recess 20 in shower enclosures. The soap container 1 is placed over a drain tray to collect any water draining the soap if the soap is returned to this position while the soap is still wet. The soap container placed on the lower part of the casing 22 can slide out of the wall recess area and hence the casing, over the shower floor using a sliding mechanism 24.

The unit is set in the wall recess, cross section shown 20. The accessory holder is attached to the sliding mechanism 23 with the pivot 26 on either side of the accessory holder 19. The accessory holder is made to be functional as fallows. The accessory holder is moved out to the position as indicated by the dotted line 27, FIG. 16, using the mechanism that extends out 23. The accessory holder is then rotated 90° clockwise on a vertical plane around the two pivots 26 situated on both sides of the accessory holder, in the direction, as indicated by the arrow marked as 28. This brings the accessory holder to the up right position facing upwards and rendering it functional and to hold bath accessories such as shampoo. This is locked in position with the latch 29 on both sides of the accessory holder. The soap container 1 is extended out of the casing 22 and hence the wall recess 20 using the arm mechanism 24. The water from the soap contained in the soap container drains into the shower floor and is drained through the sewer system, eliminating moisture. This is a compact design using a small space (recess). The absence of moisture, the lack of contact with water and the open design of the soap dish with very few points touching the bar of soap make it an ideal condition for the soap to dry efficiently and quickly.

The said compact self-draining soap dish unit described in FIGS. 13-16, for shower applications can be further modified to function using simple mechanisms and to improve utility by simplifying the design, manufacture and hence decreasing the cost of production.

Such modification is explained in the drawing, FIGS. 19 to 22. In this unit the accessory holder and the movement mechanism are similar to that of the soap dish unit described in the drawings, FIGS. 13-16. The difference is that the accessory holder is set in the casing 22 facing upwards. The casing 22 is 5" wide, 5" high and 3¼" to 4" deep. The accessory holder 18 is pulled out using the mechanism 23 to the position, as indicated by the dotted line 27 in FIG. 16. In this position, as the accessory holder is facing up, the accessory holder is functional and can hold bath accessories such as shampoo and conditioner.

The top surface of the soap dish unit is 4" long and 3" wide and ½" of the corners between the sides of the soap container 1 are rounded. A pivot 47 is attached to the middle of, the side of the soap dish which is 3" in length. This is attached to one end of a 4¼" long lever 46 and can swirl around this pivot 47. The other end of the lever swirls on another pivot 48 which is attached to the side of the casing 22 and this pivot aids the lever ¾" high on a horizontal plane from the base of the casing 22. The lever 46 is rectangular in cross section, ½" high and ⅜" wide. The vertical axis of the pivot is situated 1¾" from the rim of the casing and ¾" from the base of the casing. The distance between the centers in both of these pivots is 4". The soap container is brought out by pulling out the opposite end of the soap container, at the farther side from the pivot. The lever rotates on the pivot at 90° and extends out wards and in this position the lever is perpendicular to the original position. As the soap container is pulled, it is rotated 90° in the direction of the arrow 50, FIG. 22, to place the soap container over to the side of the casing as shown in FIGS. 20 and 22. This prevents the soap container from being directly under the accessory holder, denying access to the soap container.

The lack of moisture, the absence of direct contact of the soap with water and the open design of the soap dish combined make it the best possible condition for the soap bar to dry.

The dimensions contained in all the above descriptions are for illustrations of specific applications only and does not limit the scope of this invention, and can vary in the choice of size, shape, style, materials, metals, mechanisms and the choice of accessories. In addition to the variations described above, the components of the self-draining soap dish unit, such as the soap dish components, the concept of the repositioning mechanisms, the securing structures and the accessory holders and the variations described for each of these elements can be combined and used by interchanging these components to suit varying designs, sizes, shapes, proportions, appearances, styles, applications and utility requirements, as demonstrated in examples of modifications of the embodiment described in detail above making this a versatile invention with significant utility value to the consumer.

As used herein, the term "coupling assembly" is intended to mean those components of the system adapted to allow the lateral displacement of the soap dish with respect to the tray. More specifically, in the embodiment disclosed in FIGS. 1 through 5, the coupling assembly includes attachment mechanisms including the telescoping arm 3 and the component elements adjacent thereto. In the embodiments of FIGS. 8 and 9, the coupling assembly includes attachment members with a rotatable coupling, such as elements 15 and 17.

The invention claimed is:

1. A soap dish handling system comprising:

a soap dish with a plurality of apertures constructed for the passage of water from the soap dish;

an imperforate tray constructed for retaining water in the tray;

a primary region having a recipient area for the tray and a laterally spaced secondary region;

a coupling assembly adapted to allow the lateral displacement of the soap dish with respect to the tray, the coupling assembly including an attachment mechanism positioned adjacent to the tray and a telescoping arm with an inner end coupled to the attachment mechanism and an outer end coupled to the soap dish, the telescoping arm having a plurality of telescoping sections adapted to extend and contract upon manipulation by a user, the coupling assembly also including a coupling between the outer end of the telescoping arm and the soap dish for the adjustable positioning of the soap dish with respect to the attachment mechanism about a vertical axis of rotation, the coupling assembly adapted to allow the lateral displacement of the soap dish with respect to the tray between a rest position and an operative position, the rest position being at a location with the soap dish above the tray whereby moisture from the soap in the tray will fall through the apertures of the soap dish into the tray, the operative position being at a location over the secondary region whereby moisture from the soap dish will fall through the apertures of the soap dish and be drained away; and accessory holders and containers located in proximity to the soap dish for the storage of associated toiletry and other accessories.

2. A soap dish handling system comprising:

a soap dish with a plurality of apertures constructed for the passage of water from the soap dish;

an imperforate tray constructed for retaining water in the tray;

a primary region having a recipient area for the tray and a laterally spaced secondary region;

a coupling assembly adapted to allow the lateral displacement of the soap dish with respect to the tray, wherein the coupling assembly includes an attachment mechanism positioned adjacent to the tray and a component with an inner end coupled to the attachment mechanism and an outer end coupled to the soap dish, the coupling assembly adapted to allow the lateral displacement of the soap dish with respect to the tray between a rest position and an operative position, the rest position being at a location with the soap dish above the tray whereby moisture from the soap in the tray will fall through the apertures of the soap dish into the tray, the operative position being at a location over the secondary region whereby moisture from the soap dish will fall through the apertures of the soap dish and be drained away; and accessory holders and containers located in proximity to the soap dish for the storage of associated toiletry and other accessories.

3. A soap dish handling system comprising:

a soap dish with a plurality of apertures constructed for the passage of water from the soap dish;

an imperforate tray constructed for retaining water in the tray;

a primary region having a recipient area for the tray and a laterally spaced secondary region;

a coupling assembly adapted to allow the lateral displacement of the soap dish with respect to the tray, wherein the coupling assembly includes an attachment mechanism positioned adjacent to the tray and a component with an inner end coupled to the attachment mechanism and an outer end coupled to the soap dish, the component including a rotatable coupling between the inner and outer ends of the component and the attachment mechanism for the adjustable positioning of the component with respect to the attachment mechanism, the coupling assembly adapted to allow the lateral displacement of the soap dish with respect to the tray between a rest position and an operative position, the rest position being at a location with the soap dish above the tray whereby moisture from the soap in the tray will fall through the apertures of the soap dish into the tray, the operative position being at a location over the secondary region whereby moisture from the soap dish will fall through the apertures of the soap dish and be drained away; and accessory holders and containers located in proximity to the soap dish for the storage of associated toiletry and other accessories.

4. The system as set forth in claim 3 wherein the rotatable couplings are about an axis of rotation.

5. The system as set forth in claim 3 and further including an accessory holding means located in proximity to the tray and soap dish for the storage of associated toiletry and other accessories.

6. A soap dish handling system for facilitating the support and movement of a bar of soap in a clean, safe, convenient and economical manner comprising, in combination:

a soap dish having a base in a configuration with upstanding sidewalls and upstanding front and rear walls and with an open top to allow movement of soap into and out of the soap dish, the base and walls of the soap dish being fabricated with a plurality of apertures in the base and in the walls for the passage of water from the soap dish;

a tray constructed of a base in a configuration with upstanding sidewalls and upstanding front and rear walls and with an open top to allow movement of water into and out of the tray, the base and the walls of the tray being imperforate and fabricated for the retaining water in the tray, the tray being located on the top of a container constructed of a base with upstanding sidewalls and upstanding front and rear walls and with an open top to store soap and associated toiletry accessories;

a primary region having a recipient area for receiving and supporting the tray and a laterally spaced secondary region including a drain for receiving water and for allowing the received water to be drained away;

a coupling assembly including an attachment mechanism positioned adjacent to the tray, the coupling assembly including a rotatable coupling, the coupling assembly adapted to allow the lateral displacement of the soap dish with respect to the tray between a rest position and an operative position, the rest position being at a location with the soap dish above the tray whereby moisture from the soap in the tray will fall through the apertures of the soap dish into the tray, the operative position being at a location over the secondary area whereby moisture from the soap dish will fall through the apertures of the soap dish and be drained away; and accessory holders and containers located in proximity to the soap dish for the storage of associated toiletry and other accessories.

* * * * *